United States Patent [19]

Frost

[11] 4,263,155

[45] Apr. 21, 1981

[54] LUBRICANT COMPOSITION CONTAINING ALKALI METAL BORATE AND STABILIZING OIL-SOLUBLE ACID

[75] Inventor: Kenneth Frost, San Rafael, Calif.

[73] Assignee: Chevron Research Company, San Francisco, Calif.

[21] Appl. No.: 110,415

[22] Filed: Jan. 7, 1980

[51] Int. Cl.[3] ..... C10M 1/10; C10M 3/02; C10M 7/02

[52] U.S. Cl. ..... 252/49.8; 252/46.4; 252/49.6; 252/49.7

[58] Field of Search ..... 252/49.8, 46.4, 45.6, 252/45.7, 18

[56] References Cited

U.S. PATENT DOCUMENTS

| | | | |
|---|---|---|---|
| 3,313,727 | 4/1967 | Peeler | 252/18 |
| 3,565,802 | 2/1971 | West et al. | 252/45.4 X |
| 3,819,521 | 6/1974 | Sims | 252/18 |
| 3,846,313 | 11/1974 | Sims | 252/18 |
| 3,853,772 | 12/1974 | Adams | 252/18 |
| 3,907,691 | 9/1975 | King et al. | 252/18 |
| 3,912,639 | 10/1975 | Adams | 252/49.7 X |
| 3,912,643 | 10/1975 | Adams | 252/49.6 |
| 3,912,644 | 10/1975 | Adams | 252/49.6 |
| 3,997,454 | 12/1976 | Adams | 252/18 |
| 4,089,790 | 5/1978 | Adams | 252/18 |

*Primary Examiner*—Robert V. Hines

*Attorney, Agent, or Firm*—D. A. Newell; S. R. LaPaglia; J. J. DeYoung

[57] ABSTRACT

Disclosed is a lubricant composition containing an oil of lubricating viscosity having dispersed therein a particulate hydrated alkali metal borate and an effective amount oil soluble acid which stabilizes the composition against the adverse effects of water contamination.

7 Claims, No Drawings

LUBRICANT COMPOSITION CONTAINING ALKALI METAL BORATE AND STABILIZING OIL-SOLUBLE ACID

BACKGROUND OF THE INVENTION

The invention relates to extreme pressure lubricating oils, particularly alkali metal borate-containing lubricants.

Alkali metal borate-containing lubricants are well known in the art for their usefulness as extreme pressure lubricating oils. See, for example, U.S. Pat. Nos. 3,313,727, 3,565,802, 3,819,521, 3,846,313, 3,853,772, 3,907,691, 3,912,639, 3,912,643, 3,912,644, 3,997,454, and 4,089,790.

The borate-containing oils described in these patents have a serious deficiency in service. If water is introduced into the system containing the borate lubricant, the borate crystallizes out of the oil and forms hard granules. This crystallization decreases the extreme pressure function of the lubricant. Furthermore, it has been found that water contamination of the borate lubricant can lead to seal leakage. It is believed that the crystallization is caused by water contamination which leads to the formation of deposits on shafts at or near the seals. The turning motion of the shafts then slowly abrades the seals, thereby allowing loss of the lubricant.

U.S. Pat. No. 3,997,454 claims a hydrated potassium borate with a boron-to-potassium ratio of 2.5 to 3.5 as being superior to other alkali metal borates in resisting the adverse effects of water contamination.

It is one object of the present invention to provide an alkali metal borate-containing lubricant having improved resistance to the adverse effects of water contamination.

SUMMARY OF THE INVENTION

It has been found 0.01 to 5.0 weight percent of an oil-soluble acid of the formula:

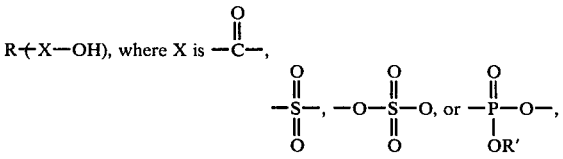

where R is an oil-solubilizing group and R′ is H or an oil-solubilizing group, substantially improves the water contamination resistance of an alkali-metal borate containing lubricant.

DETAILED DESCRIPTION OF THE INVENTION

The lubricant composition comprises an oil of lubricating viscosity, particulate hydrated alkali metal borate and an effective amount of an oil-soluble acid.

THE ALKALI-METAL BORATES

The hydrated particulate alkali-metal borates are well known in the art and are available commercially. Representative patents disclosing suitable borates and methods of manufacture include: U.S. Pat. Nos. 3,313,727; 3,819,521; 3,853,772; 3,907,691; 3,997,454; and 4,089,790, the entire disclosures of which are incorporated herein by reference.

The hydrated alkali metal borates can be represented by the following formula:

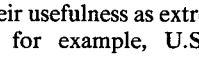

where M is an alkali metal of atomic number in the range 11 to 19, i.e., sodium and potassium, m is a number from 2.5 to 4.5 (both whole and fractional), and n is a number from 1.0 to 4.8. Preferred are the hydrated potassium borates, particularly the hydrated potassium triborates microparticles having a boron-to-potassium ratio of about 2.5 to 4.5. The hydrated borate particles generally have a mean particle size of less than 1 micron.

The alkali metal borate will generally comprise 0.1 to 60 weight percent of the lubricant, preferably 0.5 to 15 weight percent.

THE OIL-SOLUBLE ACID

The lubricant composition contains an effective amount of an oil-soluble acid to inhibit crystallization caused by water contamination of the lubricant. Generally the lubricant will contain 0.1 to 5.0 weight percent of the oil soluble acid and preferably 0.1 to 2.0 weight percent.

The oil soluble acid may be represented by the formula:

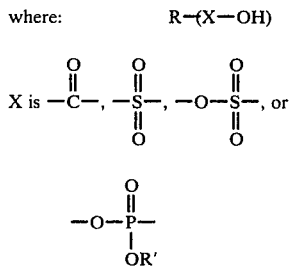

and R is an oil-solubilizing group containing at least 4 carbon atoms and R′ is H or an oil-solubilizing group containing at least 4 carbon atoms. Preferably the oil-solubilizing group contains 4 to 70 or more carbon atoms and more preferably 6 to 30 carbon atoms.

Representative carboxylic acids are: butyric acid, valeric acid, hexanoic acid, heptanoic acid, octanoic acid, nonanoic acid, decanoic acid, undecanoic acid, lauric acid, tridecanoic acid, myristic acid, pentadecanoic acid, palmitic acid, heptadeconoic acid, stearic acid, isostearic acid, nonadecanoic acid, eicosanoic acid, heneicosanoic acid, docosanoic acid, tricosanoic acid, tetracosanoic acid, pentacosanoic acid, hexacosanoic acid, heptacosanoic acid, octacosanoic acid, saturated and unsaturated fatty acids, methoxyacetic acid, butoxyacetic acid, ethythioacetic acid, 5-oxynonylcarboxylic acid, 7-chrododecanoic acid, 4-isopropyl-cyclohexane carboxylic acid, tetradecylsuccinic acid, octadecylsuccinic acid, and naphthenic acids as obtained in the distillation of crude oil. Particularly preferred are tetrapropenylsuccinic acid, oleic acid, and the naphthenic acids.

Representative phosphorus-containing acids include: dioctyl hydrogen phosphate, didodecyl hydrogen phosphate, dipentadecyl hydrogen phosphate, octacosyl hydrogen phosphate, tridecyl pentadecyl hydrogen phosphate, eicosyl nonyldecyl hydrogen phosphate, heptadecyl propyl hydrogen phosphate, methyldodecyl hydrogen phosphate, ethyl decyl hydrogen phosphate, isopropyl eicosyl hydrogen phosphate, docosyl phosphinic acid, octyl phosphinic acid, dodecylphenyl phosphinic acid, didecyl hydrogen phosphite, dodecylphenyl dihydrogen phosphite, octyl benzyl hydrogen phosphite, octadecyl dihydrogen phosphite, hexacosyl dihydrogen phosphite, nonyl tridecyl hydrogen phosphite, butyl eicosyl hydrogen phosphite, heptadecyl hydrogen phosphonite, triacontyl hydrogen phosphonite, docosyl hydrogen phosphonite, dodecyl hydrogen propanephosphonite, octyl hydrogen dodecanephosphonite, tridecylphenyl hydrogen phosphonite, tetradecyl hydrogen benzenephosphonite, octadecane phosphinous acid, and undecylbenzene phosphinous acid.

Representative sulfur-containing acids include: octanesulfonic acid, decanesulfonic acid, octadecane sulfonic acid, 8-tetradecenesulfonic acid, 2-tridecenesulfonic acid, 4-butylcyclohexane sulfonic acid, octyl hydrogen sulfate, monyldecyl hydrogen sulfate, tetradecyl hydrogen sulfate.

The lubricating oil to which the borates and the oil-soluble acid are added, can be any hydrocarbon-based lubricating oil or a synthetic base oil stock. The hydrocarbon lubricating oils may be derived from synthetic or natural sources and may be paraffinic, naphthenic or asphaltic base, or mixtures thereof. A variety of other additives can be present in lubricating oils of the present invention. These additives include antioxidants, viscosity index improvers, dispersants, rust inhibitors, foam inhibitors, corrosion inhibitors, other antiwear agents, and a variety of other well-known additives. Particularly preferred additional additives are the oil-soluble succinimides and oil-soluble alkali or alkaline earth metal sulfonates.

EXAMPLES

To 100 ml samples of a base oil containing 9 weight percent of a potassium triborate dispersion, 1.0 weight percent of a diparaffin polysulfide, 0.5 weight percent zincdialkyldithiophosphate, and 0.5 weight percent of a phenolic antioxidant were added various amounts of oil-soluble acids. Each sample was tested in a seal leakage apparatus comprising a sealed motor driven metal shaft passing through a reservoir of test oil. The seal comprised a Chicago Rawhide 10700 lip seal. Provisions were made for collecting any oil leakage. The shaft was rotated at 3200 revolutions per minute in each test. Each experiment was four hours long, started at room temperature, and test oil temperatures rose to 60° C. (140° F.) in the first 30 minutes. New Chicago Rawhide 10700 lip seals were used for each test. After each experiment was complete, the amount of oil leakage, the seal wear, the shaft deposite weight, the deposit location, and the presence of ridges at the seal shaft contact line were recorded. The results are reported in Table I.

TABLE I

PROPERTIES OF BORATE DISPERSION CONTAINING WATER

| Additive | Water Level, % | Seal Wear, $10^{-3}$ In. | Deposit Weight, mg | Leakage, ml |
|---|---|---|---|---|
| None | — | 14 | 0 | 0 |
| None | — | 13 | 0 | 0 |
| None | 1 | 24 | 30 | Trace |
| None | 1 (0.01 N HCl) | 9 | 0 | 0 |
| None | 1 (0.01 N KOH) | 14 | Shaft Deposit | Trace |
| None | 1 (0.01 N $NH_4Cl$) | 27 | 23 | Trace |
| None | 1 (0.01 N $HNO_3$) | 34 | 320 | 13 |
| 0.3 TPSA[8] | 1 | 3 | 1 | 0 |
| 0.7% Oleic Acid | 1 | 6 | Light | 3 |
| 0.5% Oleic Acid | 1 | 4 | 15[1] | 0 |
| 1% Benzoic Acid | 1 | 24 | 32[2] | 0 |
| 0.1% Acetic Acid | 1 | 22 | 3 | 1 |
| 0.5% Ethoxy Acetic Acid | 1 | 12 | 4[2] | 0 |
| 0.5% Phthalic Acid | 1 | 18 | 46 | 2 |
| 0.5% Phenyl Acetic Acid | 1 | 12 | 2 | 0 |
| 0.5% Adipic Acid | 2 | 23 | 30 | 0 |
| 0.5% Aminecarboxylate salt[4] | 2 | 7 | 2 | 0 |
| 0.1% Aminecarboxylate salt[4] | 1 | 11 | 8[2] | 0 |
| 0.5% Aminecarboxylate salt[4] | 0.5 | 7, 12 | 4 | Trace,14 |
| o.1% Aminecarboxylate salt[4] | 0.5 | 9 | 0[7] | 23 |
| 0.5% Oleylamine | 2 | 15 | 22[3] | 3 |
| 0.5% PEMO[9] | 1 | 5 | 5[2] | Trace |
| 0.1% Chlorinated Paraffin (50% Cl) | 1 | 20 | 3 | 1 |
| 0.5% Ricinoleic Acid | 1 | 10 | 15[1] | 0 |
| 0.5% Naphthenic Acids | 1 | 16 | 13[1] | 0 |
| 0.5% TPSAME[10] | 1 | 6 | 11[1] | 0 |
| 0.25% ADNS[11] | 1 | 29 | 24[3] | 2 |
| 0.5% Alkylaminephosphate | 1 | 13 | 31[3] | 0 |
| 0.5% Dioleylhydrogenphosphate | 1 | 8 | 14[6] | 0 |

TABLE I-continued

PROPERTIES OF BORATE DISPERSION CONTAINING WATER

| Additive | Water Level, % | Seal Wear, $10^{-3}$ In. | Deposit Weight, mg | Leakage, ml |
|---|---|---|---|---|
| 0.5% Polypropylene-phenol | 1 | 27, 25 | 22[3], 36[3] | 0, 4 |
| 0.5% Styrene ester of di-alkyldithio-phosphoric acid | 1 | 24 | 24[3] | 0 |
| 0.5% Alkylenebis-dialkyldithio-carbamate[5] | 1 | 23 | 23[3] | Trace |
| 0.5% $C_7$–$C_9$ ASA[13] | 1 | 4 | 3 | 0 |
| 0.03% Tolytriazole | 0.5 | 9 | 0[7] | 53 |

Footnotes
[1]No ridges at seal-shaft contact line.
[2]Thin ridge at seal-shaft contact line.
[3]No change from base lubricant.
[4]Ronco-Vaden 100 J-10.
[5]Vanderbilt OD7723X.
[6]Very thin ridge at outer seal contact line.
[7]Majority of deposit appears to have broken off.
[8]TPSA is tetrapropenylsuccinic acid.
[9]PEMO is pentaeryritolmonoleate.
[10]TPSAME is tetrapropenylsuccinicmonoester (Lubrizol 859).
[11]ADNS is ammoniumdinonylnaphthalenesulfonate.
[12]Vanlube 672
[13]Alkylsuccinicanhydride.

The above data demonstrates that water contamination of a borate-containing lubricant causes substantial seal deterioration due to deposits formed in ridges at the seal shaft contact line which eventually leads to seal leakage whereas the oil-soluble acids of the present invention are effective in substantially improving the water contamination resistance of an alkali-metal borate containing lubricant.

What is claimed is:

1. A lubricant composition comprising an oil of lubricating viscosity having dispersed therein:

(a) 0.1 to 60 weight percent of a particulate hydrated alkali metal borate and (b) 0.01 to 5.0 weight percent of an oil soluble acid of the formula:

where: R—(X—OH)

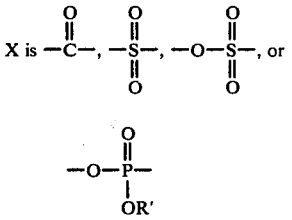

and R is an oil-solubilizing group containing at least 4 carbon atoms, and R′ is H or an oil-solubilizing group containing at least 4 carbon atoms.

2. The lubricant composition of claim 1 having dispersed therein 0.1 to 2.0 weight percent of said oil soluble acid.

3. The lubricant composition of claim 1 wherein said acid is a carboxylic acid.

4. The lubricant composition of claim 3 wherein said carboxylic acid is selected from tetrapropenylsuccinic acid, oleic acid, and the naphthenic acid.

5. The lubricant composition of claim 1 wherein said acid is a phosphorus-containing acid.

6. The lubricant composition of claim 5 wherein said phosphorus-containing acid is dioleylhydrogenphosphate.

7. The lubricant composition of claim 1 wherein said acid is a sulfur-containing acid.

* * * * *